US009365394B2

(12) United States Patent
Rees et al.

(10) Patent No.: US 9,365,394 B2
(45) Date of Patent: Jun. 14, 2016

(54) ELECTRONIC WIRE BRIDGE WITH SAFETY CIRCUIT

(71) Applicant: INVENTIO AG, Hergiswil NW (CH)

(72) Inventors: Gerald M. Rees, Mine Hill, NJ (US); Edward Nowel, Columbia, NJ (US)

(73) Assignee: Inventio AG, Hergiswil (CH)

( * ) Notice: Subject to any disclaimer, the term of this patent is extended or adjusted under 35 U.S.C. 154(b) by 794 days.

(21) Appl. No.: 13/662,699

(22) Filed: Oct. 29, 2012

(65) Prior Publication Data

US 2014/0117777 A1 May 1, 2014

(51) Int. Cl.

| | |
|---|---|
| ***B66B 5/00*** | (2006.01) |
| ***B66B 13/22*** | (2006.01) |
| *B66B 5/02* | (2006.01) |

(52) U.S. Cl.

CPC ..... *B66B 5/0087* (2013.01); *B66B 13/22* (2013.01); *B66B 5/0018* (2013.01); *B66B 5/0031* (2013.01); *B66B 5/02* (2013.01); *Y10T 307/76* (2015.04)

(58) Field of Classification Search

CPC ..... B66B 13/22; B66B 5/0087; Y10T 307/76
USPC ..... 307/115; 324/750.01
See application file for complete search history.

(56) References Cited

U.S. PATENT DOCUMENTS

| | | | | |
|---|---|---|---|---|
| 2,974,261 | A * | 3/1961 | Le Lacheur | 361/160 |
| 4,213,058 | A * | 7/1980 | Townsend | 307/40 |
| 5,731,947 | A * | 3/1998 | Hirose | 361/160 |
| 6,903,284 | B2 * | 6/2005 | Dunfield et al. | 200/51 R |
| 7,231,262 | B2 * | 6/2007 | Hollis et al. | 700/14 |
| 2009/0121731 | A1 * | 5/2009 | Wurth et al. | 324/754 |

FOREIGN PATENT DOCUMENTS

| | | | |
|---|---|---|---|
| EP | 2319791 | A1 | 5/2011 |
| WO | 2011090665 | A2 | 7/2011 |

* cited by examiner

*Primary Examiner* — Rexford Barnie
*Assistant Examiner* — Elim Ortiz
(74) *Attorney, Agent, or Firm* — Fraser Clemens Martin & Miller LLC; William J. Clemens

(57) ABSTRACT

An electronic bridge system includes a first interface to couple to an electrical or electro-mechanical installation to receive system information from the installation, and a second interface to couple to a second component of the installation, wherein the second component is to be bypassed or interrupted by the bridge system. Further, the system includes a bridge circuit coupled to the second interface and having a control port, and a safety circuit coupled to the first interface and having an output coupled to the control port. The bridge circuit is configured to cause bypassing or interrupting the second component upon activation, and the safety circuit is configured to output one of an enable signal and a disable signal as a function of the system information, wherein the enable signal activates the bridge circuit.

16 Claims, 3 Drawing Sheets

ELECTRONIC WIRE BRIDGE WITH SAFETY CIRCUIT

BACKGROUND OF THE INVENTION

The various embodiments described herein generally relate to electrical or electro-mechanical installations that are subject to service or repair during which components of such installations need to be bypassed or interrupted. More particularly, the various embodiments described herein relate to electronic wire bridges used to bypass or interrupt components in an electrical or electro-mechanical installation.

One example of an electrical or electro-mechanical installation is an elevator installation. Multi-story buildings are usually equipped with at least one elevator installation. In a generally known elevator installation, a suspension medium—such as a rope or flat belt-type rope—interconnects a counterweight and a cabin, and an electrical drive motor causes the suspension medium to move in order to thereby move the counterweight and the cabin up and down along a shaft or hoistway. An elevator controller of the elevator installation controls and monitors the operation of the elevator installation, e.g., by processing input signals received via communications network or signaling lines (e.g., from sensors, safety components (e.g., stop switches, door lock switches), etc.) and by generating control signals, which are fed to the communications network or the signaling lines.

An elevator installation in these multi-story buildings is subject to regular servicing or maintenance, testing or occasional repairs. During these procedures, it is common to use wire bridges or jumpers to bypass or interrupt certain components, e.g., a safety door switch to allow operation of the elevator installation with an open door, or a stop switch to allow a cabin to travel beyond a set stop. Once these procedures are finished, it is important that a technician removes all wire bridges, otherwise serious safety hazards exit. To minimize the risks caused by a jumper that has mistakenly been left in place, Wurtec, Inc., Ohio, USA, offers an electronic jumper that "times out" after a preprogrammed period of time.

Even though such an electronic jumper reduces the risk caused by a "forgotten" jumper, the time-out functionality of that jumper may not be sufficient to satisfy industry-standard safety requirements, especially when used for an extended period of time. There is, therefore, a need for an improved bridging or jumping technology that further reduces the potential risks associated with using jumpers in electrical or electro-mechanical installations, such as an elevator installation.

SUMMARY OF THE INVENTION

Accordingly, one aspect of such an alternative technology involves an electronic bridge system having a first interface to couple to an electrical or electro-mechanical installation to receive system information from the installation, and a second interface to couple to a second component of the installation, wherein the second component is to be bypassed or interrupted by the bridge system. Further, the system includes a bridge circuit coupled to the second interface and having a control port, and a safety circuit coupled to the first interface and having an output coupled to the control port. The bridge circuit is configured to cause bypassing or interrupting the second component upon activation, and the safety circuit is configured to output one of an enable signal and a disable signal as a function of the system information, wherein the enable signal activates the bridge circuit.

Another aspect of the alternative technology involves a method of operating an electronic bridge system in an electrical or electro-mechanical installation to bypass or interrupt a predetermined component of the installation, wherein a first interface is coupled to the installation to receive system information, wherein a second interface is coupled to the predetermined component, wherein a bridge circuit is coupled to the second interface and has a control port, and wherein a safety circuit is coupled to the first interface and has an output coupled to the control port. The method includes receiving via the first interface the system information and determining by the safety circuit using the system information if it is safe to bypass or interrupt the predetermined component. If this is the case, the method includes outputting by the safety circuit an enable signal and activating the bridge circuit so that the enable signal causes bypassing or interrupting the predetermined component.

In addition, the electronic bridge system not only includes a bridge circuit that performs the actual bypassing or interrupting, but also includes a safety circuit that provides enables or disables the bridge circuit. Such enabling or disabling provides additional safety when using the bridge system.

More particularly, the first interface of the electronic bridge system can, in certain embodiments, interface with the elevator control system. System information is thereby integrated into the bridge system, which then allows the bridge system to be sensitive and to respond to events taking place in the elevator control system. In other words, the bridge system analyzes system information, and then decides if it is truly safe, to activate the bridge circuit are not. This is different from prior art bridging systems or methods that merely mimic a wire bridge with a timer.

Furthermore, the elevator control system provides electrical power to the first interface, which is then sent to a (safety) relay. If no actual power is provided to the first interface (e.g. because a power failure affects the elevator installation), the bridge system is immediately disabled and goes into a safe mode. This is again different from prior art bridging systems or methods that would leave wire bridges or jumpers in place despite a new set of conditions (i.e., power failure) in the elevator installation. This could pose a danger if, e.g., the elevator installation "reboots" itself after a power failure. One embodiment of a bridge system described herein monitors the condition present at the first interface to determine if it is safe to activate the bypassing function of the bridge system.

In certain embodiments, the bridge system includes a selector switch. Preferably, the selector switch is configured to be manually operated by a technician. This improves the safety of the bridge system, because the function of the selector switch is clear, and cannot be activated accidentally since operating the selector switch requires a deliberate act by the technician.

In one embodiment, the bridge system includes an additional interface that interfaces with the elevator installation, so that in this embodiment two interfaces to the elevator installation are available. One interfaces with safety devices and allows monitoring of a point in the elevator installation, which is deemed to be "safe." When this condition is not met anymore, it would not be safe to have the bridge system active. For example, an emergency stop switch could be a monitor point. If the stop switch is not active, then it is safe to activate the wire bridge and for the technician to do the work required on-site. If, however, someone presses the stop switch the bridge system needs to be disabled immediately, since this condition could mean that the bridge system should not be active while there is a clear intention not to move the car.

The other interface receives a signal from the elevator installation, e.g., an output signal from a microprocessor. That signal indicates that the elevator installation is in a diagnostic mode, and that, therefore, it is safe to bridge or interrupt components of the elevator installation. If this signal is not present, e.g., because another person attempted to put the elevator installation into normal operation, the bridge system is disabled immediately.

In one embodiment, the bridge system includes a further interface to couple to an additional component of the installation, wherein the additional component is to be interrupted by the bridge system during a bypass operation. That is, in addition to bypassing the selected component, yet another component can be disabled or interrupted. One example is the power supply to a door controller. It is an advantage, that the bridge system can be arranged to ensure that any time that a bypassing occurs, the power supply to the door controller is disabled during this time.

In one embodiment of the bridge system, a stop switch is provided as part of the system. It is an advantage that this stop switch allows disabling the bridging function "remotely," i.e., without having to physically remove a wire bridge, which may be located in an area where high voltage or current is present. In addition, to be safer, the stop switch can be pressed by the technician faster and more convenient due to its location in the bridge system.

BRIEF DESCRIPTION OF THE SEVERAL VIEWS OF THE DRAWINGS

The novel features and method steps characteristic of the invention are set out in the claims below. The various embodiments of the invention, however, as well as other features and advantages thereof, are best understood by reference to the detailed description, which follows, when read in conjunction with the accompanying drawings, wherein:

DETAILED DESCRIPTION OF SEVERAL EMBODIMENTS OF THE INVENTION

Figure 1:
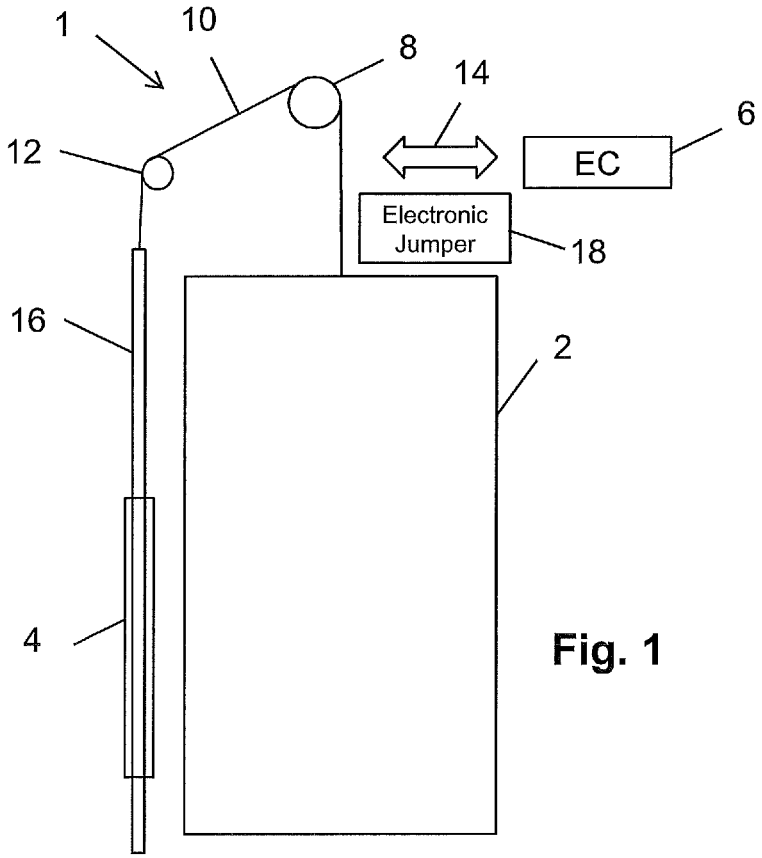
FIG. 1 shows a schematic illustration of one application of an electronic bridge (jumper) system in an elevator installation.

FIG. 1 schematically illustrates one exemplary application of an electronic bridge system, as described herein, in an elevator installation 1. The electronic bridge system is hereinafter referred to as jumper system 18. It is contemplated, however, that the jumper system 18 is not limited to bridging (or bypassing or jumping) components, but may also be used for interrupting components. The terms "bridge," "bypass" and "jump" are used herein interchangeably. Further, the jumper system's use in not limited to application in elevator installations, but has general applicability in any electronic or electro-mechanical system or installation subject to service, maintenance, testing or repair during which wires need to be bridged or components need to be bypassed or interrupted, and in which a wire bridge (i.e., a jumper) left in place causes a safety hazard. With that in mind, details of various embodiments of the jumper system 18 and its operation are described herein with reference to the elevator installation 1 shown in FIG. 1.

The elevator installation 1 of FIG. 1 is, e.g., installed in a multi-story building, whereas individual floors are not shown in FIG. 1. The elevator installation 1 includes a cabin 2 connected via a suspension medium 10 (e.g., one or more round ropes or flat belt-type ropes) to a counterweight 4, wherein the cabin 2 and the counterweight 4 are movable up and down in opposite directions in a vertically extending shaft or hoistway (not indicated in FIG. 1). In the situation shown in FIG. 1, the jumper system 18 is coupled to the elevator installation 1 and available for use in accordance with the embodiments described herein. For example, a technician may have installed the jumper system 18 to service or repair the elevator installation 1. In that case, the jumper system 18 is a portable device that the technician carries from one elevator installation to another.

Alternatively, the jumper system 18 may be installed in the elevator installation 1 for a longer period of time, potentially permanently. In that case, the jumper system 18 may have various outputs each leading, e.g., to a predetermined component or device. The outputs can be controlled to selectively bypass or interrupt one or more of the components or devices. In such a installed jumper system 18 it is an advantage, that the jumper system 18 has the ability to monitor the elevator installation 1, quasi as an "external" system, and, therefore, can be left at sites, where a typical jumper is always removed when its operation is done—due to the potential hazard of leaving a jumper in a system by accident and overriding a safety device. Also, if service personnel need to return to the same location for several days, a "jumper" provided by the jumper system 18 can safely be installed once and only removed once the task is completed, thereby requiring less preparation time and wiring each time.

As indicated in FIG. 1, an elevator controller 6 (in FIG. 1 labeled as EC for elevator controller) of the elevator installation 1 interacts with various components of the elevator installation 1 (e.g., a drive motor 8, car and landing operating panels, and safety chain components) via a communications network and/or signaling lines; these communications means are represented in FIG. 1 through a double arrow 14. The elevator controller 6 is configured to control and monitor the performance and operation of the elevator installation 1, as is known in the art. In addition, the elevator controller 6 is in one embodiment communicatively coupled to the jumper system 18 to provide information to the jumper system 18, as described below in more detail.

The jumper system 18, in particular when configured as a portable system, can selectively be coupled to one of these components, and to the elevator controller 6, e.g., to receive (status) information that the jumper system 18 uses, e.g., to determine whether or not to bridge a device or switch when the elevator installation 1 is in a particular status. Since the jumper system 18 uses the status information, additional safety is provided when the jumper system 18 is about to be used in the elevator installation 1. Embodiments of the jumper system 18, its components of and functions, are described below in more detail with reference to FIG. 2 and FIG. 3.

Referring again to the structure of the elevator installation 1 shown in FIG. 1, the terms "shaft" and "hoistway" are used herein interchangeably. Depending on a particular embodiment, the shaft may be surrounded by walls, e.g., four walls, or may not be completely enclosed as, e.g., in a so-called panorama elevator where a cabin with at least one transparent (e.g., glass) wall moves along only one wall of a building. Also, one of ordinary skill in the art will appreciate that in another embodiment an elevator installation may include more than one cabin, each moving in a separate shaft and coupled via a suspension medium to a counterweight. In yet another embodiment, more than one cabin may move within the same shaft.

The exemplary elevator installation of FIG. 1 has guide rails for both the cabin 2 and the counterweight 4. For ease of illustration, FIG. 1 shows a guide rail 16 for the counterweight 4 only, but not for the cabin 2; however, it is contemplated that the cabin 2 is guided by at least one guide rail as well. In a typical embodiment of an elevator installation, the shaft includes two guide rails for the counterweight 4 and two guide rails for the cabin 2.

A drive 8 is coupled to the suspension medium 10 and configured to act upon the suspension medium 10 to move the cabin 2 and the counterweight 4. These components are arranged in accordance with a 1:1 roping arrangement; however, other roping arrangements (e.g., 2:1) are possible as well. Next to the drive 8, a deflection sheave 12 is positioned above the counterweight 4 to deflect the suspension medium 10 between the drive 8 and the counterweight 4, as shown in FIG. 1, so that the cabin 2 and the counterweight 4 can move along different paths without colliding. It is contemplated that in another embodiment the positions of the drive 8 and the deflection sheave 12 are changed, i.e., the drive 8 is positioned above the counterweight 4 and the deflection sheave 12 above the cabin 2.

Furthermore, in one embodiment, the elevator installation 1 is a traction-type elevator, i.e., a drive sheave coupled to the drive 8 acts upon the suspension medium 10 by means of traction between the drive sheave and the suspension medium 10. In such an embodiment, the suspension medium 10 serves as a suspension and traction medium.

The foregoing illustrates that an elevator installation may have various configurations with regard to the disposition of its components (e.g., drive motor 8 in overhead space or pit, with or without a deflection sheave, various roping arrangements (e.g., 1:1 or 2:1)) or the type of suspension medium used to move the counterweight 4 and the cabin 2. The skilled person, however, will appreciate that any kind of elevator installation in accordance with one of the various configurations may be used in connection with the jumper system 18 described herein. As such, use of the jumper system 18 is not limited to a particular configuration of the elevator installation 1.

Figure 2:
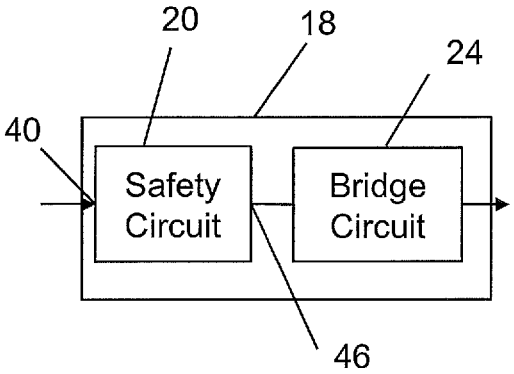
FIG. 2 is a schematic illustration of the electronic bridge system's general configuration.

FIG. 2 is a schematic illustration of one embodiment of the jumper system 18's general configuration. In the illustrated embodiment, the jumper system 18 has an interface 40, 48 to connect to safety devices or the elevator controller 6 of the elevator installation 1, and an interface 52, 54 to connect to a switch or device or component that is to be bypassed, or a circuit to be interrupted during bypass operation. Examples of such a safety devices are stop switches in the pit or overhead space (i.e., the space between the shaft ceiling and the ceiling of the cabin 2 in its highest operational position) of the elevator installation 1, or door switches. Examples of inputs from the elevator controller 6 via the interface 48 are: a signal from the elevator controller 6 that the elevator installation 1 is in "test" or "maintenance" mode, a signal from the elevator controller 6 that the cabin 2 is at a certain location (e.g., the jumper function could be deactivated once the cabin 2 reaches level at a floor), or a signal from the elevator controller 6 that the doors are in a specified state (e.g., the jumper function could be disabled when the doors are not closed). Examples of devices to be bypassed by means of the interface 52 are certain safety devices which are not yet installed in the elevator installation 1 during a preliminary start-up of the elevator controller 6, devices to be temporarily overridden to perform periodic tests for the elevator, etc. Circuits to be interrupted via the interface 54 are circuits providing control signals to a door that should not move during a test mode, buzzers or indicators which a technician would not want to go off during the test mode, alternate power sources which could attempt to run the cabin 2 during a perceive power outage, etc.

The jumper system 18 includes a safety circuit 20 and a bridge circuit 24, wherein the safety circuit 20 is coupled to the bridge circuit 24 via ports 46, 53. The safety circuit 20 is further coupled to the interface 40, 48, and the bridge circuit 24 is further coupled to the interface 52, 54. If the jumper system 18 is configured as a portable device, the safety circuit 20 and the bridge circuit 24, may be placed in a housing, wherein the interfaces 40, 48, 52, 54 have attached cables or are accessible to receive cables for coupling to the elevator installation 1. If the jumper system 18 is installed in the elevator installation 1, potentially permanently, the jumper system 18 may not have a housing. In the latter case, the safety circuit 20 and the bridge circuit 24 may be located at different locations within the elevator installation 1, as long as communication between these two circuits 20, 24 is possible.

Figure 3:
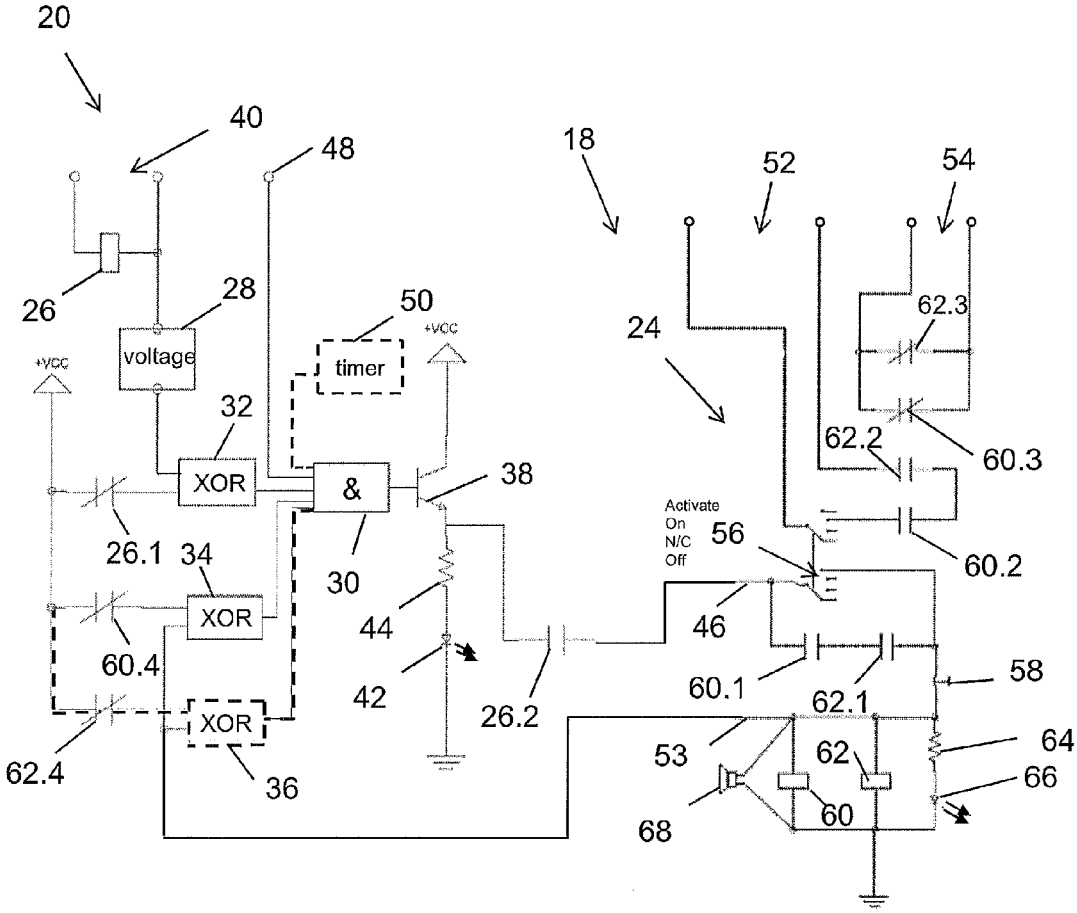
FIG. 3 is a schematic illustration of one embodiment of the electronic bridge system.

FIG. 3 is a schematic illustration of one embodiment of the electronic jumper system 18, wherein both circuits 20, 24 are shown by means of high level electronic circuit diagrams. Each circuit 20, 24 includes a relay 26, 60 illustrated by means of a symbol for a coil (rectangle), and switches 26.1, 26.2, and 60.1, 60.2, 60.3, 60.4, respectively, illustrated by means of symbols for normally open switches (two parallel lines) and normally closed switches (two parallel lines with diagonal line). In the embodiment of FIG. 3, the bridge circuit 24 includes an additional relay 62 with switches 62.1, 62.2, 62.3, 62.4. As described below, the relay 62 is optional and provides for redundancy, if such redundancy is required or preferred. The circuits 20, 24 are connected to a power supply, as schematically indicated by means of VCC terminals and typical symbols for electrical ground.

In the illustrated embodiment, the safety circuit 20 further includes a voltage matching circuit 28, logical (exclusive OR (XOR)) gates 32, 34, 36, a logical (AND) gate 30, a transistor 38, a resistor 44, an optical indicator 42 (hereinafter light emitting diode (LED) 42), and a timer 50. The voltage matching circuit 28 is configured to adjust voltages received via the interface 40 to a voltage level defined for input signals of the XOR gate 32. The timer 50 is depicted by means of dashed lines to indicate that it is optional. Likewise, the XOR gate 36 and the switch 62.4 are shown by means of dashed lines to indicate that these components may not be present in a non-redundant embodiment. The logical gates 30, 32, 34, 36 and the transistor 38 form a logic circuit that may have various configuration as long as the function described herein is provided. It is contemplated, e.g., that the logical gates 30, 32, 34, 36 are shown as individual components for illustrative purposes only, and that these gates may be integrated into a single component. Further, the logical functions (AND and XOR) provided by these gates, 30, 32, 34, 36 may be implemented by two or more individual logical gates. Generally, the skilled person will recognize that variations of the illustrated circuit, in particular with respect to particular, real-life implementations, are possible that accomplish the same functionality and accomplishes the same goal of self-checking and input evaluation.

The coil part of the relay 26 (via its two terminals) is connected to +/− terminals of the interface 40, wherein the + terminal is further connected to an input of the voltage matching circuit 28. If the +/− terminals are active (i.e., a voltage is applied across these +/− terminals) a current flows through the coil part of the relay 26. The output of the voltage matching circuit 28 is connected to a first input of the XOR gate 32, and a second input of the XOR gate 32 is connected to a terminal of the switch 26.1, whose other terminal is connected to the power supply terminal VCC. An output of the XOR gate 32 is connected to an input of the AND gate 30. Other inputs of the AND gate 30 are connected to the interface 48, an output of the XOR gate 34, an output of the XOR gate 36 and an output of the timer 50. An input of the XOR gate 34 is connected to a terminal of the switch 60.4, whose other terminal is connected to the power supply terminal VCC. Another input of the XOR gate 34 is connected to the interface 52 that couples the safety circuit 20 to the bridge circuit 24. Similarly, an input of the XOR gate 36 is connected to a terminal of the switch 26.3, whose other terminal is connected to the power supply terminal VCC, and another input of the XOR gate 36 is connected to the interface 52.

An output of the AND gate 30 is connected to a base of the transistor 38, wherein its collector is connected to the power supply terminal VCC and its emitter is connected to a first terminal of the resistor 44 and a terminal of the switch 26.4, whose other terminal is connected to the interface 46. A second terminal of the resistor 44 is connected to the LED 42, which is further connected to ground.

Referring to the bridge circuit 24, the bridge circuit 24 includes a further a relay 60 and associated switches 60.1, 60.2, 60.3, a relay 62 and associated switches 62.1, 62.2, 60.3, a selector switch 56, a resistor 64, and optical indicator 66 (e.g., a light emitting diode (LED)), a buzzer or loudspeaker 68 and a stop button 58. The coil parts of the relays 60, 62 are arranged in parallel to each other and parallel to the buzzer 68 and the serial arrangement of the optical indicator 66 and the resistor 64. One side of the resulting arrangement is coupled to electrical ground and the other side is coupled to the port 53 that connects the bridge circuit 24 to the safety circuit 20. Furthermore, one terminal of the stop button 58 is connected to the port 52.

The selector switch 56 is in the illustrated embodiment a double-throw switch, e.g., with four positions/outputs. In another embodiment, however, the selector switch 56 may have three positions/outputs. The illustrated selector switch 56 has a first switch part with one input and four outputs, and a second switch part with one input and four outputs, wherein the switch parts are coupled to each other via a selector so that, e.g., a technician selects one of four output pairs with a single turn of the selector. In each switch part of the illustrated embodiment, the outputs are referred to as positions "Activate", "On", "N/C" and "Off" (shown top down in FIG. 3). The skilled person will appreciate that the position "N/C" may be omitted, or used for a different function, such as "standby."

The selector switch 56 provides for a manual activation of a particular jumper function or jumper sequence. The manually activated selector switch 56 initiates the jumper function or sequence, i.e., the selector switch 56 energizes the relays 60, 62 if the XOR gates 32, 34, 36 provide power through the selector switch 56. As mentioned above, this improves the safety of the bridge system 18, e.g., because it cannot be activated accidentally since operating the selector switch 56 requires a deliberate act by the technician.

In the illustrated embodiment, the selector is in the position Off. The input of the first switch part is connected to the port 46 and a terminal of the (normally open) switch 60.1 whose other terminal is connected to a terminal of the (normally open) switch 62.1; the other terminal of that switch 62.1 being connected to a further terminal of the stop button 58 and to the position Activate of the first switch part. The input of the second switch part is connected to a first terminal of the interface 52, wherein a second terminal of the interface 52 is connected to a serial arrangement of the switches 60.2 and 62.2. A terminal of the switch 60.2 is connected to the position On of the second switch part.

The switches 60.3 and 62.3 are arranged in parallel to each other. That parallel arrangement of the switches 60.3, 62.3 is connected to the two terminals of the interface 54.

As to the kind of optical indicators 42, 66—here configured as LEDs—it is contemplated that any other visual indicator device (e.g., lamp, display, etc.) may be used. These optical indicators 42, 66 assist the technician to visually determine the status of the safety circuit 20 and the bridge circuit 24. More particularly, the indicator 66 alone, or in combination with the buzzer 68, warns the technician when the bridging function is active. Further, it is contemplated that the optical indicators 42, 66 may be replaced with other signaling devices, such as buzzers, or be omitted if a visual status determination is not required. Also, the buzzer 68 may be omitted, or combined with the optical indicator 55. Most importantly, however, the optical indicators 42, 66 and the buzzer 68 remind the technician that the jumper system 18 is active. This reduces the likelihood that, e.g., the bypass function of the jumper system 18 is left in place.

It is to be noted that the separation of the safety circuit 20 and the bridge circuit 24 into two physically separate circuits is mainly for illustrative purposes. It is contemplated that a specific physical embodiment of the jumper system 18 may not have such a separation and that the borders between the circuits 20, 24 may be fluid, which includes mixing of the elements of the circuits 20, 24. For example, in FIG. 3 the switches 60.4, 62.4 are illustrated to be part of the safety circuit 20 even though the relays 60, 62 to which they belong are part of the bridge circuit 24.

Figure 4:
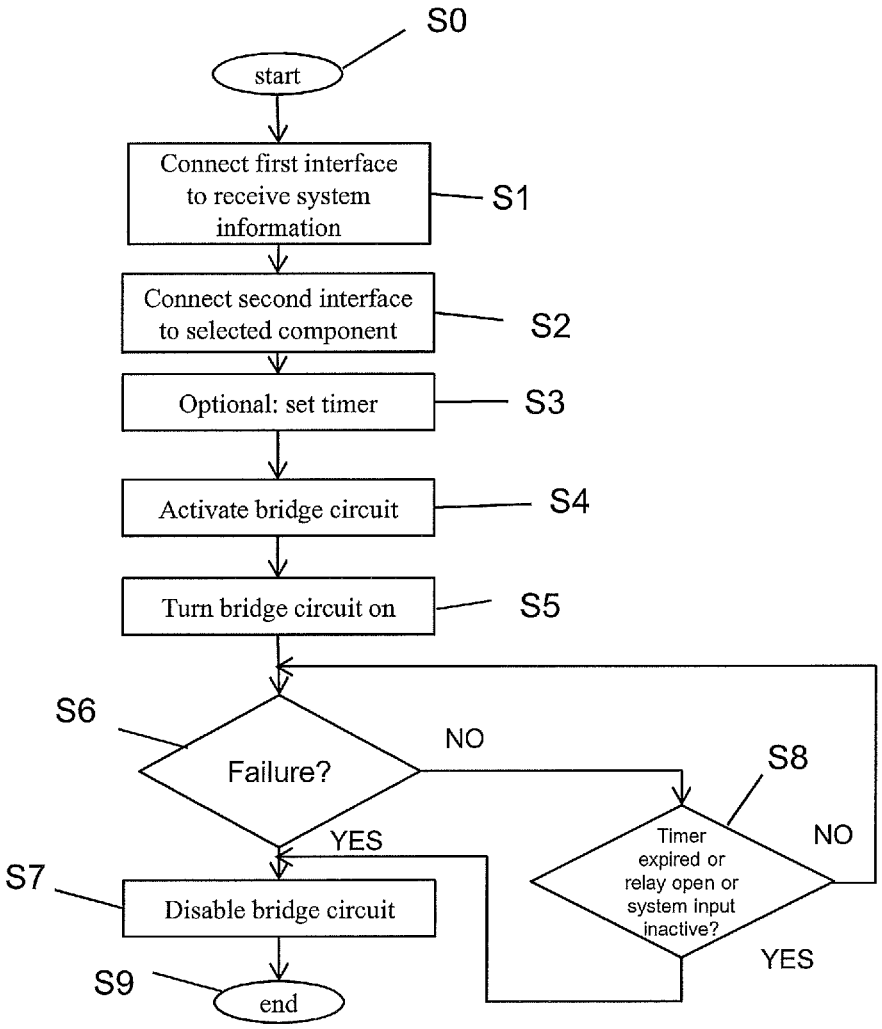
FIG. 4 is a flow diagram of one embodiment of a method of operating the electronic bridge system in an elevator installation.

FIG. 4 is a flow diagram of one embodiment of a method of operating the electronic jumper system 18 having a configuration as described with reference to FIGS. 2 and 3. Further, this embodiment of the method is described with reference to a portable electronic jumper system 18. The method starts at a step S0, and ends at a step S9.

Proceeding to a step S1, the method includes connecting the interface 40 of the safety circuit 20 to a safety device or component of the elevator installation 1 to receive system information. As discussed above, examples of safety devices are stop switches or door switches. In one embodiment, the interface 40 has two terminals that are connected—via individual wires or a cable—in parallel to the safety device.

Proceeding to a step S2, the method includes connecting at least one of the interfaces 52, 54, to the component to be bypassed or interrupted, respectively. Based on a particular task and/or elevator installation 1, the technician decides whether or not to connect the interface 52 (bypass function), or the interface 54 (interrupt function), or both (bypass and interrupt functions). In the illustrated embodiment, each interface 52, 54 has two terminals that connect in parallel, again via individual wires or cables, to the component.

In addition, the technician may decide to connect interface 48, e.g., to the elevator controller 6. In that case, the jumper system 18 receives a signal indicative of, e.g., whether not the elevator installation is in a test mode or periodic maintenance is performed. For example, the signal may be an enable or abort signal provided by microprocessor. The microprocessor must indicate a safe state before the bridge circuit 24 can be activated. As to the sequence of connecting the interfaces 40, 48, 52, 54, it is contemplated that these interfaces may be executed in a different order or at substantially the same time.

Proceeding to a step S3, the method includes setting the (optional) timer 50 to a predetermined length of time. The length of time may be manually set by a technician depending on the estimated duration of the service or maintenance process. This time a function limits deactivation of the bridge circuit 24.

Now that at least the interface 40 and potentially the interface 48 are connected, and the optional timer 50 is set, the safety circuit 20 is operational. The voltage available at the interface 40 causes a current to flow through the coil part of the relay 26 thereby opening the switch 26.1 and closing the switch 26.2. A voltage (logic 1, e.g., about 5 V) at the output of the AND gate 30 switches the transistor 38 on and a current flows from the VCC power supply through the transistor 38, the resistor 44 and the optical indicator 42 causing the optical indicator 42 to emit visible light, which indicates that the jumper system 18 is ready. As described below, the bridge circuit 24 can only be activated if the jumper system 18 is ready. The current causes a voltage drop (e.g., 5 V, as may be defined to operate the relays 60, 62) across the resistor 44, wherein that voltage is available at the port 46 as an enable signal via the closed switch 26.2. In case the transistor 38 is switched off, the voltage drop across the resistor 44 is about 0 V resulting in a disable signal at the port 46. The resistor 44 provides a voltage drop so that the optical indicator 42 (e.g., an LED) operates at the proper voltage.

The output of the AND gate 30 is at the state "logic 1" only if all its inputs are at state "logic 1". In FIG. 3, this means that each one of the timer 50, the interface 48, and the XOR gates 32, 34, 36 provides a state "logic 1". The outputs of the XOR gates 32, 34, 36 are at state "logic 1" only if only one input is at state "logic 1". With the switch 26.1 being opened, the respective input of the XOR gate 32 is now disconnected from the VCC power supply and, hence, a state "logic 0" is applied to this input. The second input of the XOR gate 32 is connected to the voltage matching circuit 28, and receives a state "logic 1" once the interface 40 is connected.

The first inputs of the XOR gates 34, 36 are connected to the VCC power supply as long as the switches 60.4, 62.4, respectively, are closed. The second inputs of the XOR gates 34, 36 are connected to the port 53 and, hence, to the relays 60, 62. The port 53, therefore, provides feedback information from the bridge circuit 24 to the safety circuit 20. Before activation (see step S4), the relays 60, 62 are inactive and the second inputs of the XOR gates 34, 36 receive a state "logic 0". In this situation, each XOR gate 32, 34, 36 outputs a state "logic 1".

Proceeding to a step S4, the method includes activating the bridge circuit 24. For example, the technician turns the selector switch 56 to the position activate, whereby the port 46 is coupled—via the stop button 58—to the relays 60, 62 and the resistor 64. A voltage at the port 46 causes a current to flow through the coil parts of the relays 60, 62, the buzzer 68 and the serial connection of the resistor 64 and the optical indicator 66. The current through the relays 60, 62 opens the switches 60.4, 62.4 disconnecting the first inputs of the XOR gates 34, 36 from the VCC power supply, i.e., these inputs are set to the states "logic 0". The voltage drop at the resistor 64 causes a state "logic 1" at the second inputs of the XOR gates 34, 36 insuring that the output of the XOR gates 34, 36 remain at the state "logic 1". Further, the current through the relays 60, 62 causes the switches 60.1, 60.2, 62.1, 62.2 to close, and the switches 60.3, 62.3 to open.

Proceeding to a step S5, the method includes turning the bridge circuit 24 on. For example, once the bridge circuit 24 is activated, the technician turns the selector switch 56 to the position on. The current flows now from the port 46 through the closed switches 60.1, 62.1 to the relays 60, 62. Further, the path between the terminals of the interface 52 is now closed via the selector switch being in the position on and the closed switches 60.2, 62.2. This closed path bridges the component connected to the interface 52. As to the path between the terminals of the interface 54, the now open switches 60.3, 62.3 interrupt that path so that any component connected in series to that path is electrically disconnected.

Proceeding to a step S6, the method includes determining if a failure occurs in the jumper system 1. One example of such a failure is an internally detected failure of the jumper system 18 such as a relay 60, 62 that does not switch. If no internal failure occurs, the method proceeds along a NO branch to a step S8, and if any of the inputs to the AND gate 30 fail to be true, the method proceeds along a YES branch to a step S7. In step S7, the jumper system 18 is automatically disabled.

Referring to the step S8, the method evaluates one or more parameters. For example, if the timer 50 is in use, the method determines if the timer 50 expired. If the timer 50 expired, the method proceeds along the YES branch to the step S7. If the timer 50 has not yet expired, the method proceeds along the NO branch to the step S6. Similarly, if the (safety) relay 26 is open (inactive) or there is no signal at the interface 48, the method proceeds along the YES branch to the step S7 to disable the bridge circuit 24.

This allows the relays 26, 60, 62 to be monitored for failure. For example, if a contact state does not match a coil state of the relay 60, the relay circuit and its bridging/bypassing function are disabled. After any correction of the relay 60, the selector switch 56 must be manually activated to restart the jumper function. This provides the same level of monitoring as required for elevator control circuits, as specified in American code A. 17.1, rule 2.26.9.3.

In one embodiment, the jumper system 18 can be disabled or deactivated by turning the selector switch 56 to "Off", or by pressing the stop button 58. This may be necessary in an emergency situation. In such a situation, the technician can quickly disabled the jumper function by turning the selector switch 56 to the position Off, or by pressing the stop button 58. The position Off interrupts the path between the terminals of the interface 52, and the pressed stop button 58 interrupts the path to the relays 60, 62.

As mentioned above, the embodiment shown in FIG. 3 provides for redundancy due to the presence of the two relays 60, 62. This redundancy provides that a single relay failure cannot activate the jumper function of the jumper system 18. This provides the same level of monitoring as required for elevator control circuits, as specified for example, in American elevator code A17.1, rule 2.26.9.4. It is contemplated that the embodiment shown in FIG. 3 can be converted into a non-redundant embodiment if, e.g., the relay 62 and the associated switches 62.1, 62.2, 62.3 and 62.4 together with the XOR gate 36 are removed. In such a non-redundant embodiment, the AND gate 30 is modified to have inputs for only two XOR gates 32, 34.

The relay 26 may be referred to as a safety relay, because it permits monitoring of conditions external to the jumper system 18. If, e.g., a safety device interrupts the safety circuit 20, the bridge circuit 24 is disabled.

The skilled person will appreciate that at least some of the electronic components of the detector system are configured as integrated circuits that are packaged in housings for easy handling and achieving a low form factor. Further, the skilled person will appreciate that such integrated circuits may include other functionalities to facilitate operating and handling the jumper system 18.

It is apparent that there has been disclosed a technology for bypassing and/or interrupting components of an electrical or electro-mechanical installation that fully satisfy the objects, means, and advantages set forth herein before. For example, providing as safety circuit to a bridge circuit reduces the potential risks associated with bridging components of an installation. More particularly, the safety and reliability of an elevator installation are improved and the number of call-backs may be reduced.

What is claimed is:

1. An electronic bridge system, comprising:

a first interface to couple to an electrical or electro-mechanical installation to receive system information from the installation;

a second interface to couple to a second component of the installation, wherein the second component is to be bypassed or interrupted by the bridge system;

a bridge circuit coupled to the second interface and having a control port, the bridge circuit configured to cause bypassing or interrupting the second component upon activation;

a safety circuit coupled to the first interface and having an output coupled to the control port, the safety circuit configured to output one of an enable signal and a disable signal as a function of the system information, wherein the enable signal activates the bridge circuit; and wherein the bridge circuit includes a selector switch and a relay having a coil part, a first switch and a second switch, wherein the second switch is connected in series to terminals of the second interface when the selector switch is in a position "on," and configured to close a path between the terminals, wherein the first switch is connected to the control port to close a path to the coil part of the relay, and wherein the selector switch is arranged to be parallel to the first switch when the selector switch is in a position "activate".

2. The system of claim 1, wherein the bridge circuit includes an emergency switch arranged in the path to the coil part of the relay to interrupt that path.

3. The system of claim 1, wherein the bridge circuit includes at least one of an acoustic indicator and an optical indicator arranged in parallel to the coil part of the relay.

4. The system of claim 1, wherein the bridge Circuit includes a third interface to couple to a third component of the installation, wherein the third component is to be interrupted by the bridge system.

5. The system of claim 4, wherein the relay of the bridge circuit has a third switch connected in series to terminals of the third interface and configured to interrupt a path between terminals of the third interface.

6. The system of claim 1, wherein the safety circuit includes a logic circuit and a relay having a coil part, a first switch and a second switch, wherein the coil part of the safety circuit is connected in series to terminals of the first interface so that available system information activates the relay of the safety circuit, wherein the second switch of the safety circuit is connected to the output port and to the logic circuit outputting one of the enable signal and the disable signal, wherein the second switch of the safety circuit is closed when the enable signal is present, and wherein logic circuit has inputs to receive system information and feedback information from the bridge circuit.

7. The system of claim 6, wherein the safety circuit includes a timer coupled to an input of the logic circuit and is able to bridge system upon expiration of a predetermined time.

8. The system of claim 6, wherein when the safety circuit includes another interface coupled to an input of logic circuit and adapted to connect to the installation to receive additional system information.

9. The system of claim 1, further comprising a housing that houses at least in the interfaces, the bridge circuit and the safety circuit.

10. An electronic bridge system, comprising:

a first interface to couple to an electrical or electro-mechanical installation to receive system information from the installation;

a second interface to couple to a second component of the installation, wherein the second component is to be bypassed or interrupted by the bridge system;

a bridge circuit coupled to the second interface and having a control port, the bridge circuit configured to cause bypassing or interrupting the second component upon activation;

a safety circuit coupled to the first interface and having an output coupled to the control port, the safety circuit configured to output one of an enable signal and a disable signal as a function of the system information, wherein the enable signal activates the bridge circuit; and wherein the bridge circuit includes a selector switch, a first relay and a second relay, each relay having a coil part, a first switch and a second switch, wherein the second switches are connected in series to terminals of the second interface when the selector switch is in a position "on," and configured to close a path between the terminals, wherein the first switches are connected to the control port to close a path to the coil part of the relay, and wherein the selector switch is arranged to be parallel to the first switches when the selector switch is in a position "activate".

11. The system of claim 10, wherein each relay of the bridge circuit has a third switch, and wherein the third switches are connected in series to terminals of the third interface and configured to interrupt a path between terminals of the third interface.

12. A method of operating an electronic bridge system in an electrical or electro-mechanical installation to bypass or interrupt a predetermined component of the installation, wherein a first interface is coupled to the installation to receive system information, wherein a second interface is coupled to the predetermined component, wherein a bridge circuit is coupled to the second interface and has a control port, and wherein a safety circuit is coupled to the first interface and has an output coupled to the control port, the method comprising:

receiving via the first interface the system information;

determining by the safety circuit using the system information if it is safe to bypass or interrupt the predetermined component;

outputting by the safety circuit an enable signal if it is safe to bypass or interrupt the predetermined component;

activating the bridge circuit so that the enable signal causes bypassing or interrupting the predetermined component; and wherein the bridge circuit includes a selector switch and a relay having a coil part, a first switch and a second switch, wherein activating the selector switch to a position "on" connects the second switch in series to terminals of the second interface and is configured to close a path between the terminals, wherein the first switch is connected to the control port to close a path to the coil part of the relay, and wherein activating the selector switch to a position "activate" arranges the selector switch to be parallel to the first switch.

13. The method of claim 1, wherein activating the bridge circuit includes setting the selector switch to a first position and then to a second position.

14. The method of claim 12, further comprising disabling the bridge circuit if a failure occurs within one of the bridge circuit and the safety circuit.

15. The method claim 12, further comprising disabling the bridge circuit if the system information indicates an unsafe condition.

16. The method of claim 12, further comprising disabling the bridge circuit if a predetermined time period expired.

* * * * *